US006345958B1

(12) United States Patent
Chen

(10) Patent No.: US 6,345,958 B1
(45) Date of Patent: Feb. 12, 2002

(54) PRESSURE ADJUSTING DEVICE FOR ENGINE COOLING SYSTEM

(76) Inventor: Jenn-Tzong Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/854,896

(22) Filed: May 11, 2001

Related U.S. Application Data

(63) Continuation-in-part of application No. 09/371,878, filed on Aug. 8, 1999.

(51) Int. Cl.[7] ..... F04B 49/00; F04B 39/10; F04B 23/00; F04B 19/00; G01M 3/04

(52) U.S. Cl. ..... 417/63; 417/238; 417/313; 417/559; 417/569; 73/49.7

(58) Field of Search ..... 417/63, 569, 559, 417/238, 313; 73/49.7, 40, 49.2

(56) References Cited

U.S. PATENT DOCUMENTS 3,014,361 A * 12/1961 Black ..... 73/40
3,035,436 A * 5/1962 Johnson ..... 73/40
3,115,031 A * 12/1963 Harry ..... 73/40
3,313,144 A * 4/1967 Johnson ..... 73/49.7
3,852,996 A * 12/1974 Klaubert et al. ..... 73/40.5 R
4,235,100 A * 11/1980 Branchini ..... 73/49.7
5,518,047 A * 5/1996 Alexandrowski ..... 141/59
5,557,966 A * 9/1996 Corry ..... 73/49.7

* cited by examiner

*Primary Examiner*—Charles G. Freay
*Assistant Examiner*—Timothy P. Solak
(74) *Attorney, Agent, or Firm*—Alan Kamrath; Rider, Bennett, Egan & Arundel, LLP

(57) ABSTRACT

A pressure adjusting device has a pumping device, a connector device, and a connection pipe connected to the pumping device and the connector device. The pumping device has a hollow cylinder, a plunger device inserted through the hollow cylinder, a cover covering the hollow cylinder, a check valve and a non-return valve inserted in the cover, and an inhale joint and an exhale joint connected to the cover. The connector device has a stepped post, a threaded rod inserted through the stepped post, a handle bar disposed on the stepped post, and a button disposed on the handle bar and receiving the threaded rod. The threaded rod has a head portion inserted in the connection pipe.

2 Claims, 14 Drawing Sheets

PRESSURE ADJUSTING DEVICE FOR ENGINE COOLING SYSTEM

The present invention is a continuation-in-part of application Ser. No. 09/371,878, filed on Aug. 8, 1999, now abandoned.

BACKGROUND OF THE INVENTION

The present invention relates to a pressure adjusting device for engine cooling system. More particularly, the present invention relates to an air inflation and extraction device for a radiator of a vehicle.

A conventional air inflation device and a conventional air extraction device cannot be combined together. Therefore, the user should use two devices to inflate air into a radiator and to extract air from the radiator.

U.S. Pat. No. 5,557,966 has disclosed a cooling system pressure testing device which has a bladder and a plump. However, the pump can inflate air only.

U.S. Pat. No. 662,980 has disclosed a pumping device which has two spherical balls disposed in two valve devices. A connecting tube separates the valve devices. The purpose of U.S. Pat. No. 662,980 is to provide a simple device to pump liquid. Therefore, the pumping device cannot be used to pump air or gas.

U.S. Pat. No. 5,664,626 has disclosed a mechanical plug device which is used to extract fluid samples from a well. An interior of the well does not expose to an outside atmosphere.

SUMMARY OF THE INVENTION

An object of the present invention is to provide a pressure adjusting device which has a stepped post to be inserted in various inlets of different radiators while the radiators have different sizes.

Another object of the present invention is to provide a pressure adjusting device which can inflate air into a radiator and to extract air from the radiator.

Another object of the present invention is to provide a pressure adjusting device which can combine an air inflation tool and an air extraction tool together.

Accordingly, a pressure adjusting device comprises a pumping device, a connector device, and a connection pipe connected to the pumping device and the connector device. The pumping device has a hollow cylinder, a plunger device inserted through the hollow cylinder, a cover, a check valve, a non-return valve, an inhale joint, an inhale pressure meter, an exhale joint, and an exhale pressure meter. The hollow cylinder has an inner interior, a through hole, a vent aperture, and a distal thread. The plunger device has a drive rod, a disk disposed on a first end of the drive rod, a piston disposed on a second end of the drive rod, and an O-ring surrounding the piston. The piston is inserted in the inner interior of the hollow cylinder. The drive rod is inserted through the through hole. The cover has an inner thread engaging with the distal thread of the hollow cylinder, a round aperture receiving the check valve and a circular aperture receiving the non-return valve. A lower end of the inhale joint is inserted in the round aperture. A bolt fastens the cover and the inhale joint together. The inhale joint has an inhale head. A lower end of the exhale joint is inserted in the circular aperture. A screw fastens the cover and the exhale joint together. The exhale joint has an exhale head. The inhale joint is connected to the inhale pressure meter. The exhale joint is connected to the exhale pressure meter. The connector device has a stepped post having a through aperture, a threaded rod inserted through the through aperture, a collar enclosing a lower end of the stepped post, a handle bar disposed on the stepped post, and a hollow button disposed on the handle bar. The threaded rod has a head portion, a bottom flange, a threaded portion, and a vent hole. A washer encloses the bottom flange. The handle bar has a flat plate and two bevel plates connected to the flat plate. The flat plate has a center hole. An annular insertion block is inserted in the hollow button. The annular insertion block has a threaded interior receiving the threaded portion of the threaded rod. The threaded rod passes through the center hole of the flat plate and the hollow button. The head portion of the threaded rod is inserted in an end of the connection pipe. The check valve has a first funnel-shaped hole and a first bulletheaded ball inserted in the first funnel-shaped hole. The non-return valve has a second funnel-shaped hole and a second bulletheaded ball inserted in the second funnel-shaped hole.

DETAILED DESCRIPTION OF THE INVENTION

Figure 1:
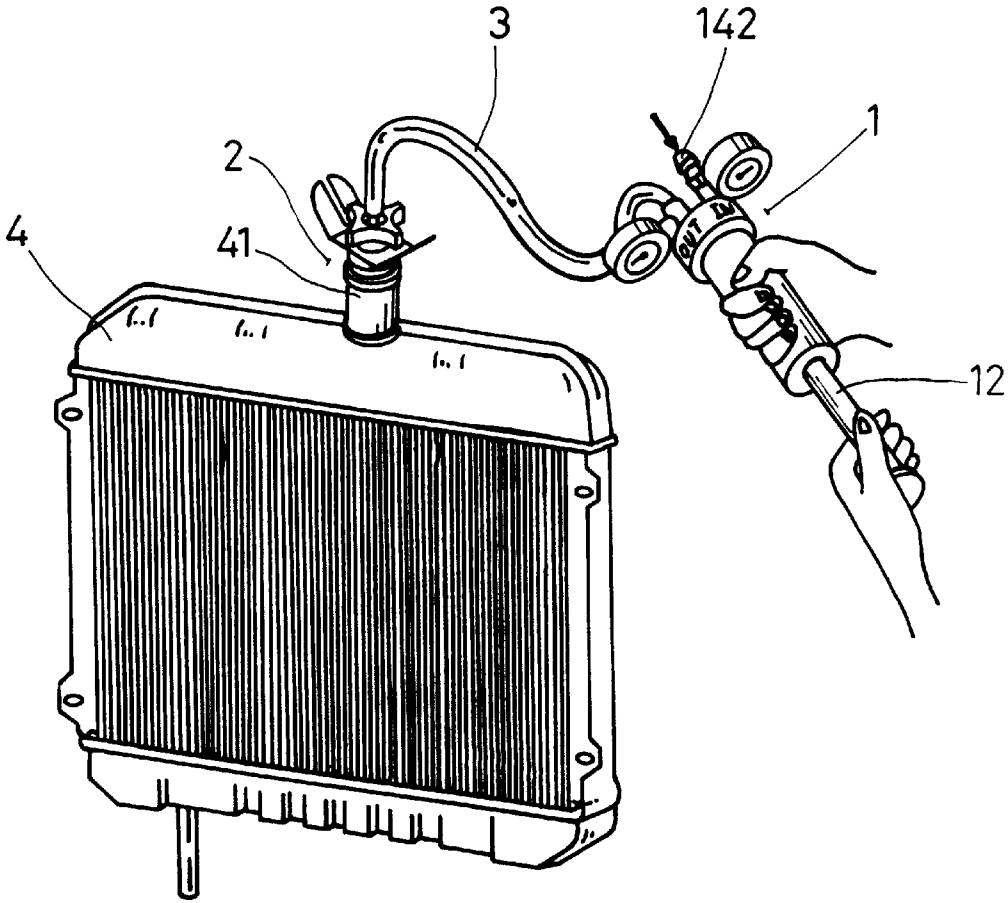
FIG. 1 is a schematic view illustrating a pressure adjusting device of a preferred embodiment inflating air into a radiator.
Figure 2:
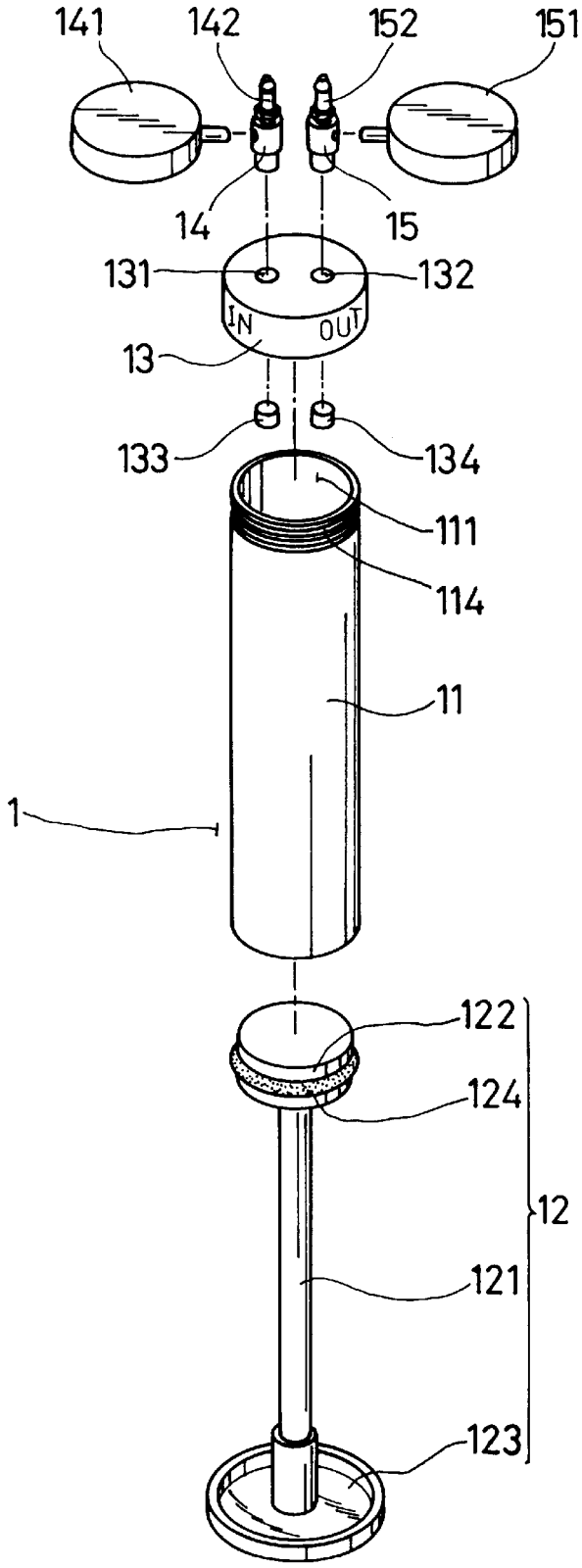
FIG. 2 is a perspective exploded view of a pumping device of a preferred embodiment in accordance with the present invention.
Figure 3:
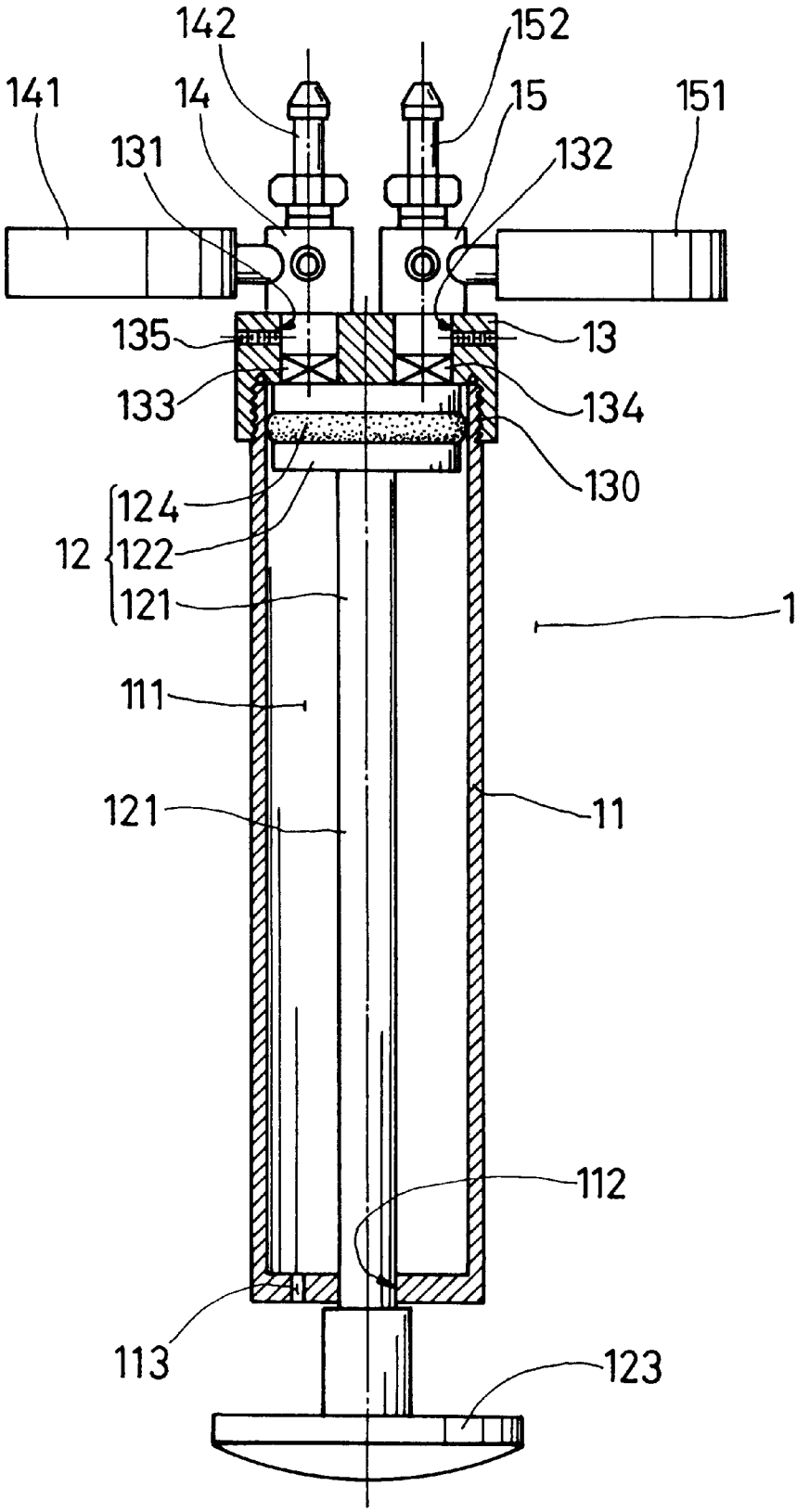
FIG. 3 is a sectional assembly view of a pumping device of a preferred embodiment in accordance with the present invention.
Figure 4:
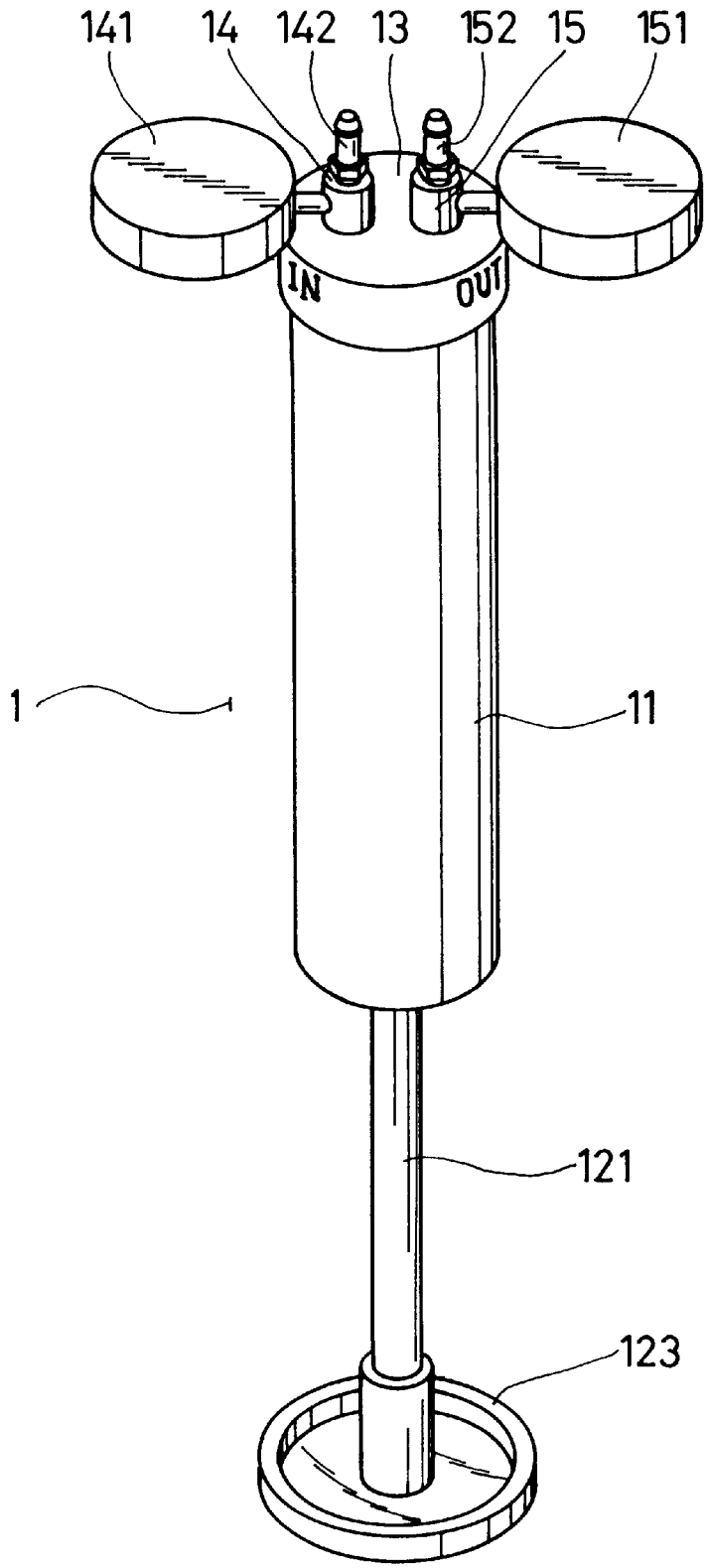
FIG. 4 is a perspective assembly view of a pumping device of a preferred embodiment in accordance with the present invention.
Figure 5:
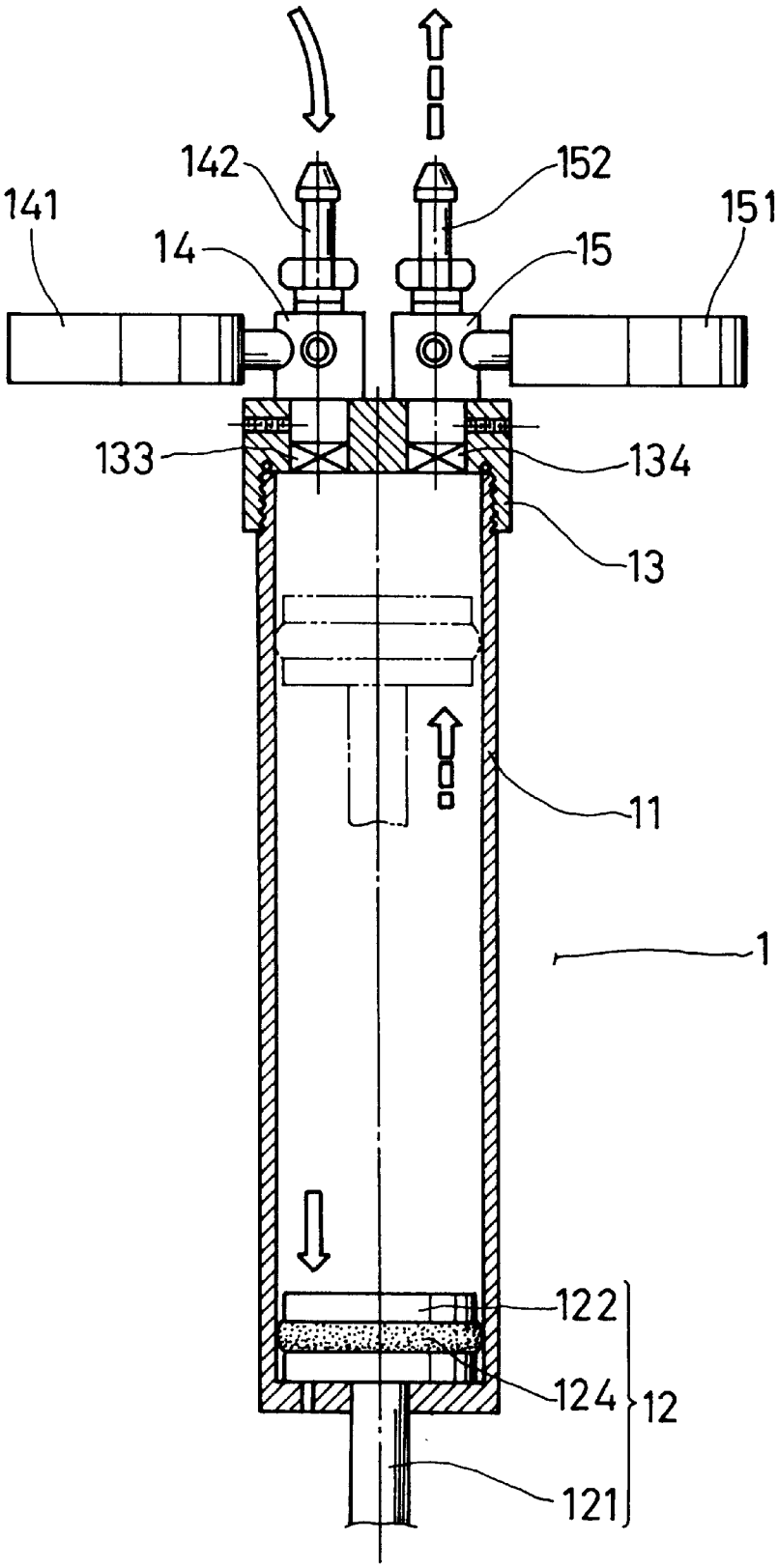
FIG. 5 is a schematic view illustrating an operation of a pumping device of a preferred embodiment in accordance with the present invention.
Figure 6:
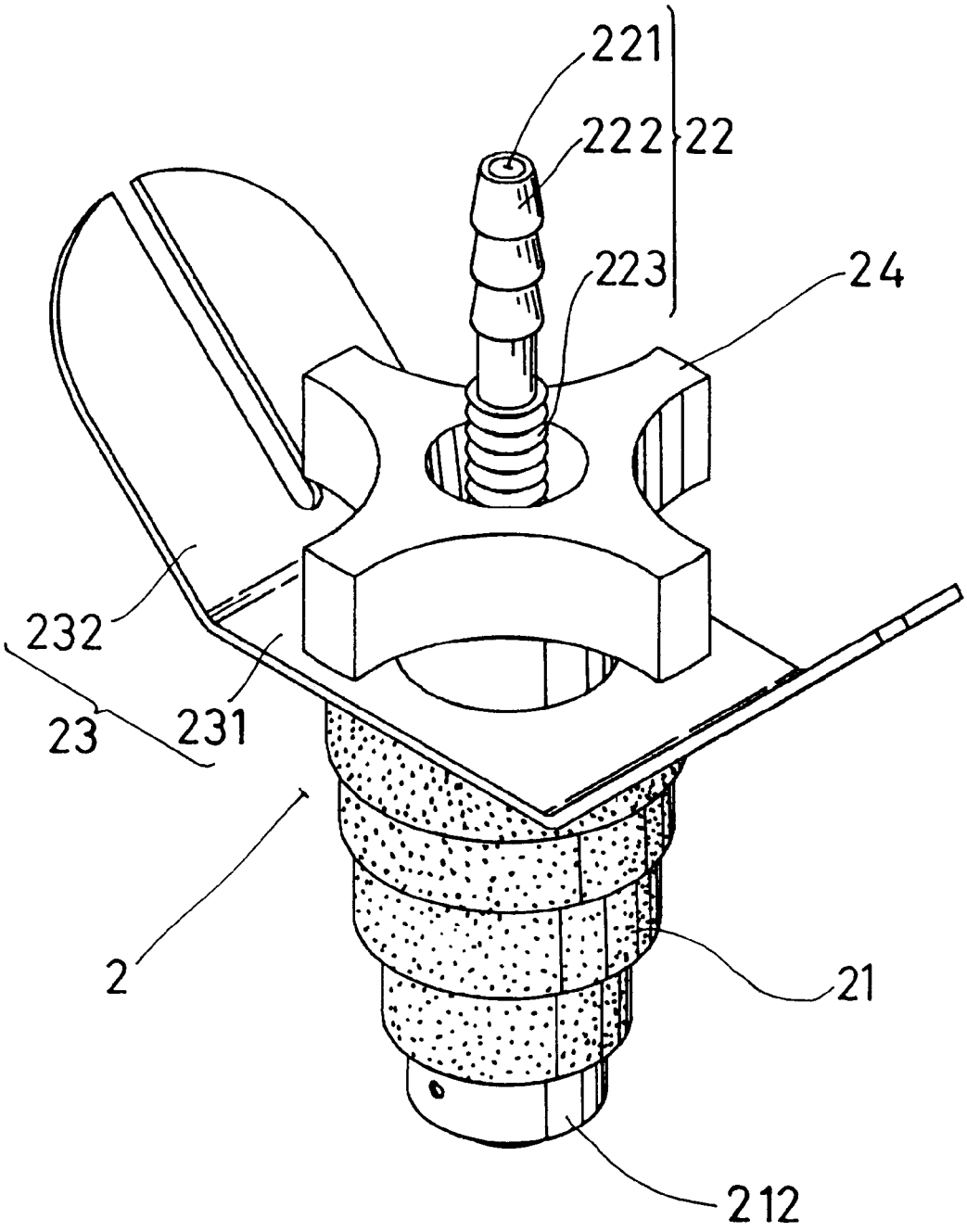
FIG. 6 is a perspective assembly view of a connector device of a preferred embodiment in accordance with the present invention.
Figure 7:
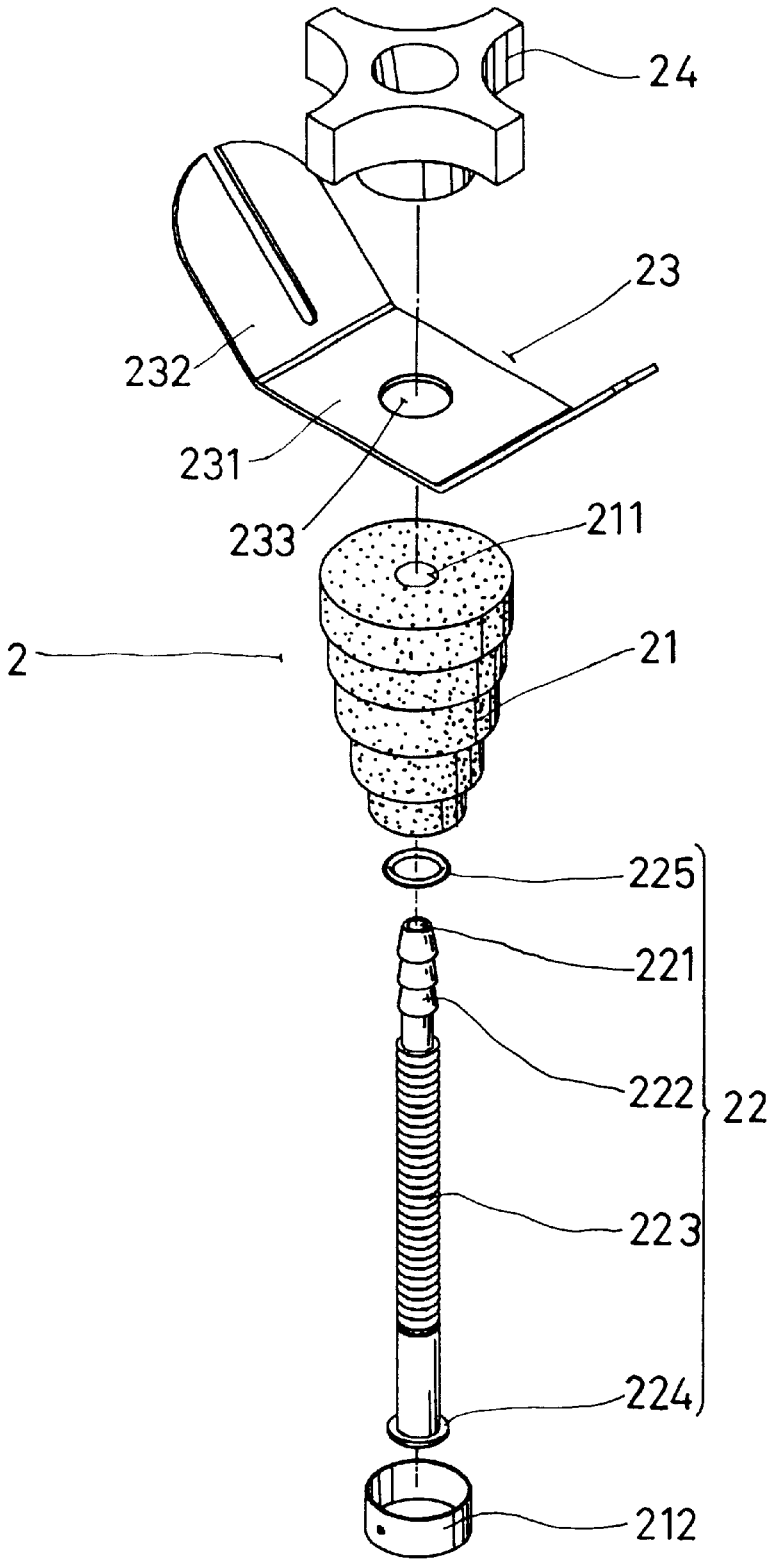
FIG. 7 is a perspective exploded view of a connector device of a preferred embodiment in accordance with the present invention.
Figure 8:
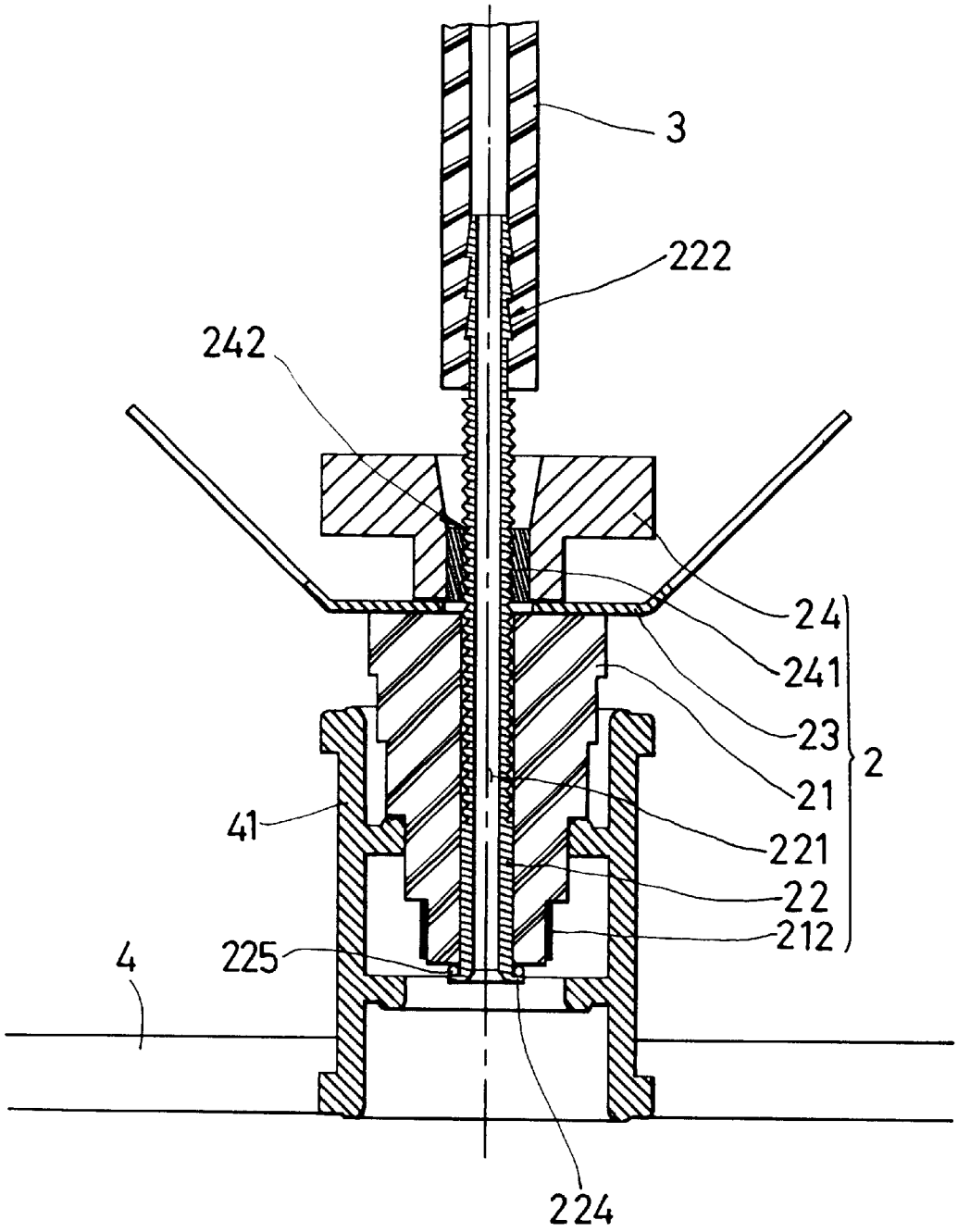
FIG. 8 is a schematic view illustrating a connector device of a preferred embodiment inserted in an inlet of a radiator.

Referring to FIGS. 1 to 8, a pressure adjusting device comprises a pumping device 1, a connector device 2, and a connection pipe 3 connected to the pumping device 1 and the connector device 2.

The pumping device 1 has a hollow cylinder 11, a plunger device 12 inserted through the hollow cylinder 11, a cover 13, a check valve 133, a non-return valve 134, an inhale joint 14, an inhale pressure meter 141, an exhale joint 15, and an exhale pressure meter 151.

The hollow cylinder 11 has an inner interior 111, a through hole 112, a vent aperture 113, and a distal thread 114.

The plunger device 12 has a drive rod 121, a disk 123 disposed on a first end of the drive rod 121, a piston 122 disposed on a second end of the drive rod 121, and an O-ring 124 surrounding the piston 122.

The piston 122 is inserted in the inner interior 111 of the hollow cylinder 11. The drive rod 121 is inserted through the through hole 112.

The cover 13 has an inner thread 130 engaging with the distal thread 114 of the hollow cylinder 11, a round aperture 131 receiving the check valve 133 and a circular aperture 132 receiving the non-return valve 134. The check valve 133 and the non-return valve 134 are located in two opposite directions.

A lower end of the inhale joint 14 is inserted in the round aperture 131. A bolt 135 fastens the cover 13 and the inhale joint 14 together. The inhale joint 14 has an inhale head 142.

A lower end of the exhale joint 15 is inserted in the circular aperture 132. The exhale joint 15 has an exhale head 152.

The inhale joint 14 is connected to the inhale pressure meter 141. The exhale joint 15 is connected to the exhale pressure meter 151.

The connector device 2 has a stepped post 21 having a through aperture 211, a threaded rod 22 inserted through the through aperture 211, a collar 212 enclosing a lower end of the stepped post 21, a handle bar 23 disposed on the stepped post 21, and a hollow button 24 disposed on the handle bar 23. The stepped post 21 tapers downward.

The threaded rod 22 has a head portion 222, a bottom flange 224, a threaded portion 223, and a vent hole 221. A washer 225 encloses the bottom flange 224.

The handle bar 23 has a flat plate 231 and two bevel plates 232 connected to the flat plate 231. The flat plate 231 has a center hole 233.

An annular insertion block 241 is inserted in the hollow button 24. The annular insertion block 241 has a threaded interior 242 receiving the threaded portion 223 of the threaded rod 22.

The threaded rod 22 passes through the center hole 233 of the flat plate 231 and the hollow button 24.

The head portion 222 of the threaded rod 22 is inserted in an end of the connection pipe 3.

The connector device 2 is inserted in an inlet 41 of a radiator 4. The stepped post 21 can be inserted in various inlets 41 of different radiators 4 while the radiators 4 have different sizes.

Figure 11:
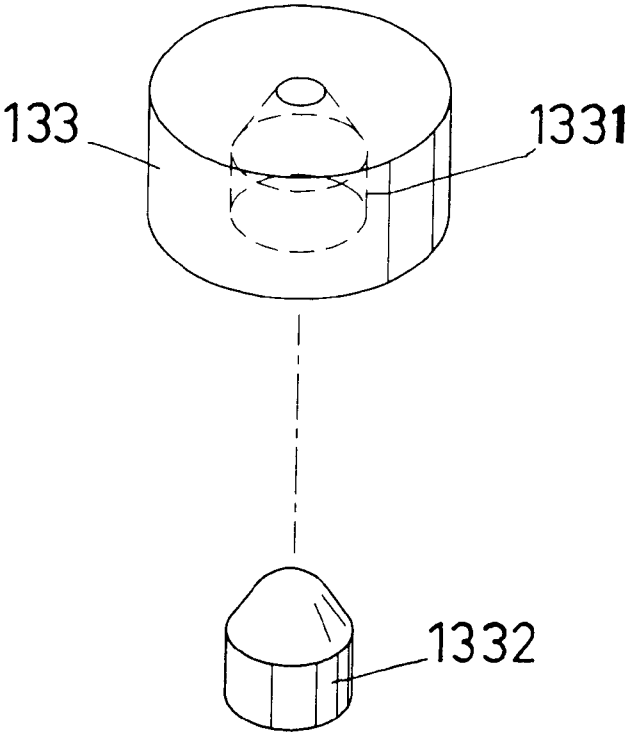
FIG. 11 is a perspective exploded view of a check valve of a preferred embodiment in accordance with the present invention.
Figure 13:
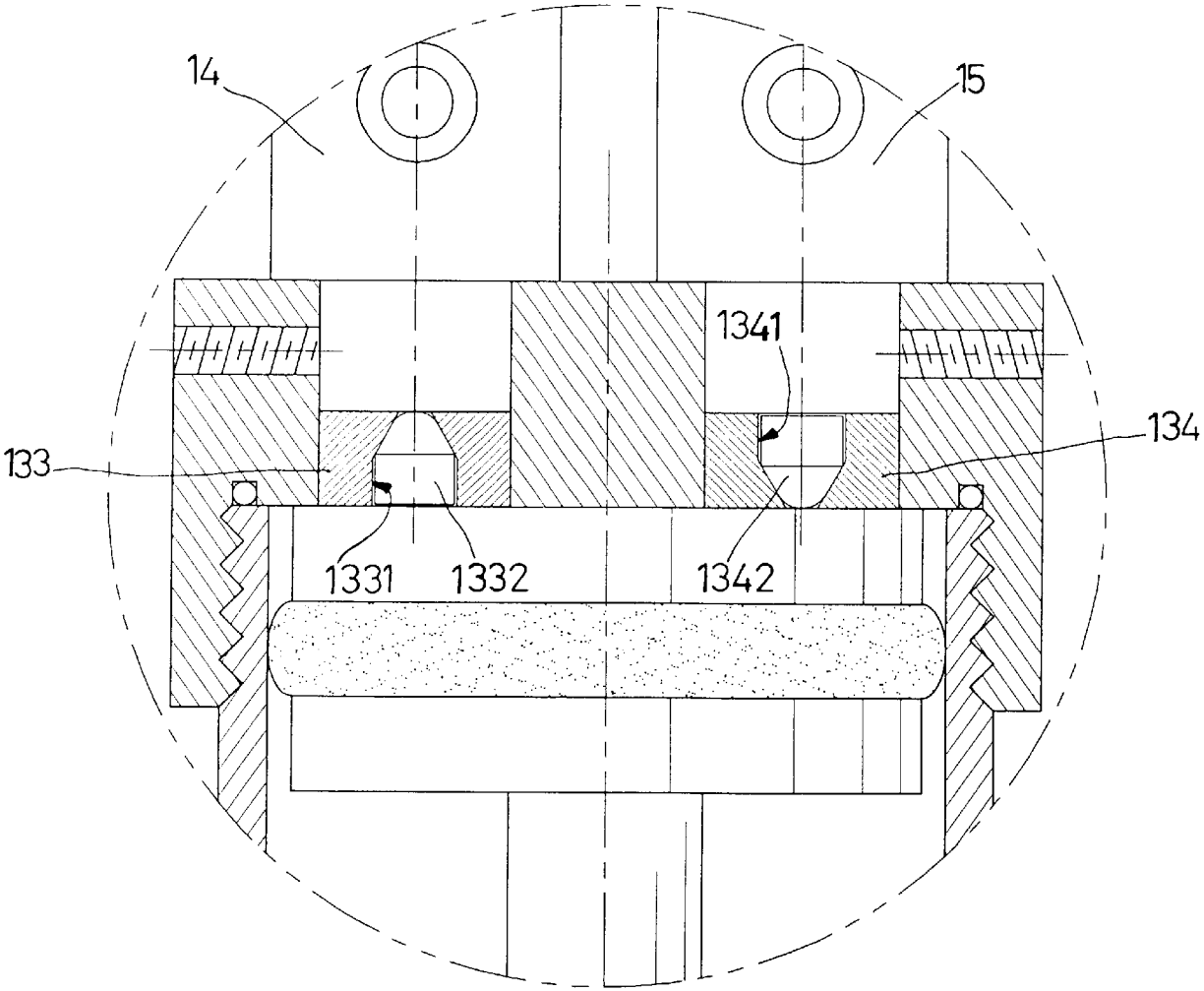
FIG. 13 is a sectional schematic view illustrating locations of a check valve and a non-return valve in a pressure adjusting device of a preferred embodiment.
Figure 14:
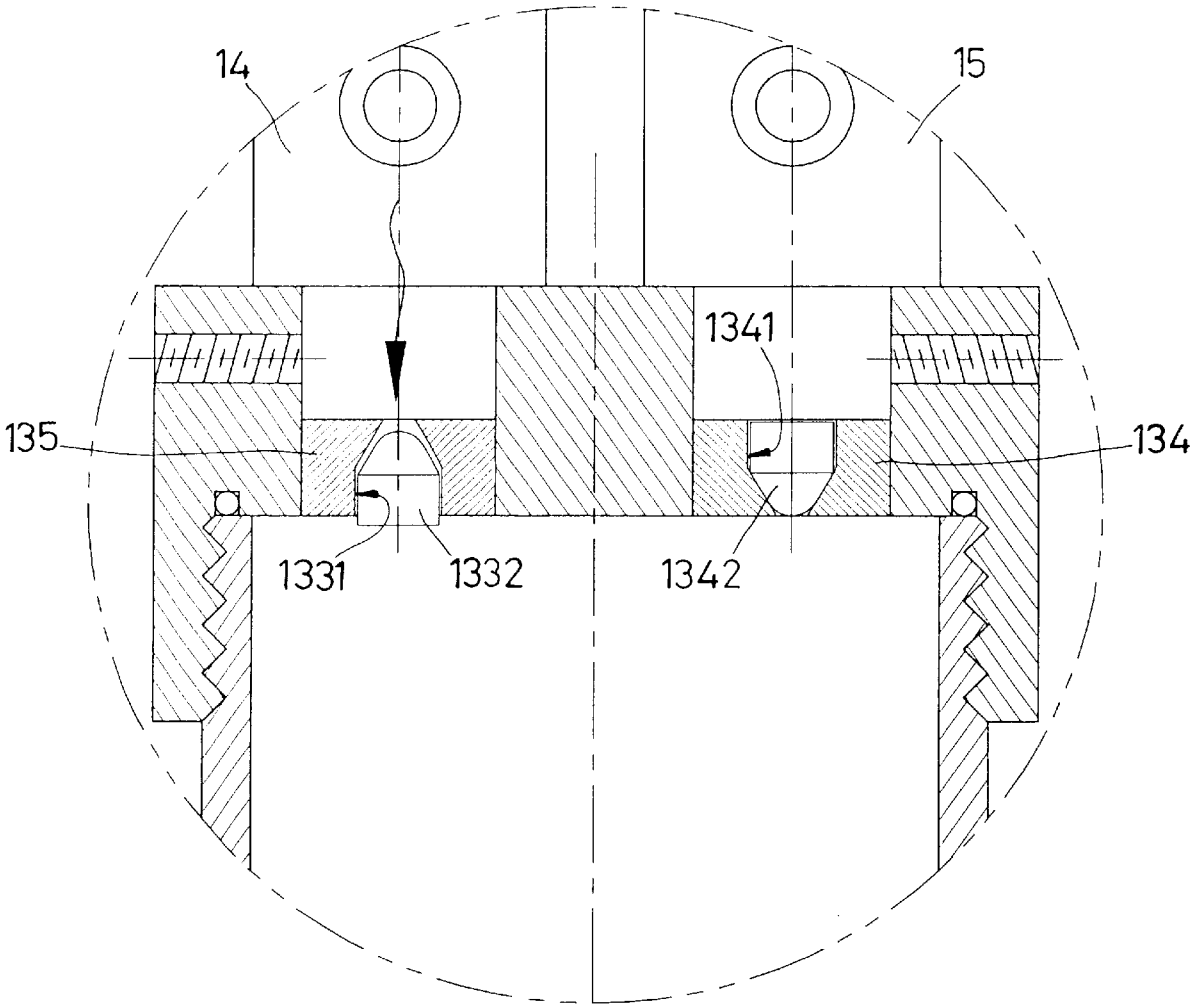
FIG. 14 is a sectional schematic view illustrating air flows into a check valve.

Referring to FIGS. 11, 13 and 14, the check valve 133 has a first funnel-shaped hole 1331 and a first bulletheaded ball 1332 inserted in the first funnel-shaped hole 1331. When air flows from the inhale joint 14 into the check valve 133, the air passes through a gap between the first funnel-shaped hole 1331 and the first bulletheaded ball 1332 to enter the inner interior 111 of the hollow cylinder 11. The check valve 133 is a one-way valve.

Figure 12:
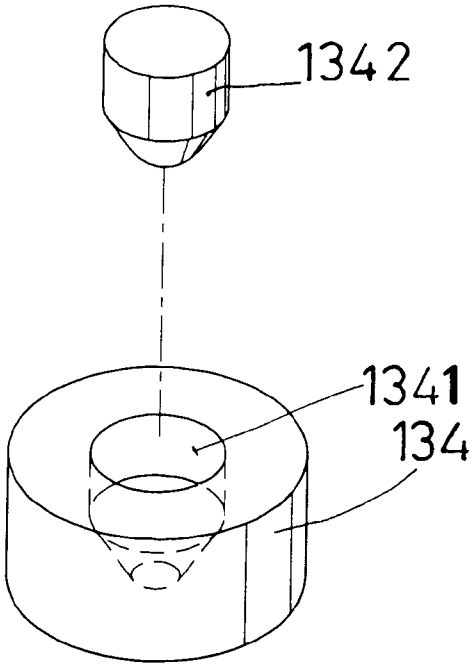
FIG. 12 is a perspective exploded view of a non-return valve of a preferred embodiment in accordance with the present invention.
Figure 15:
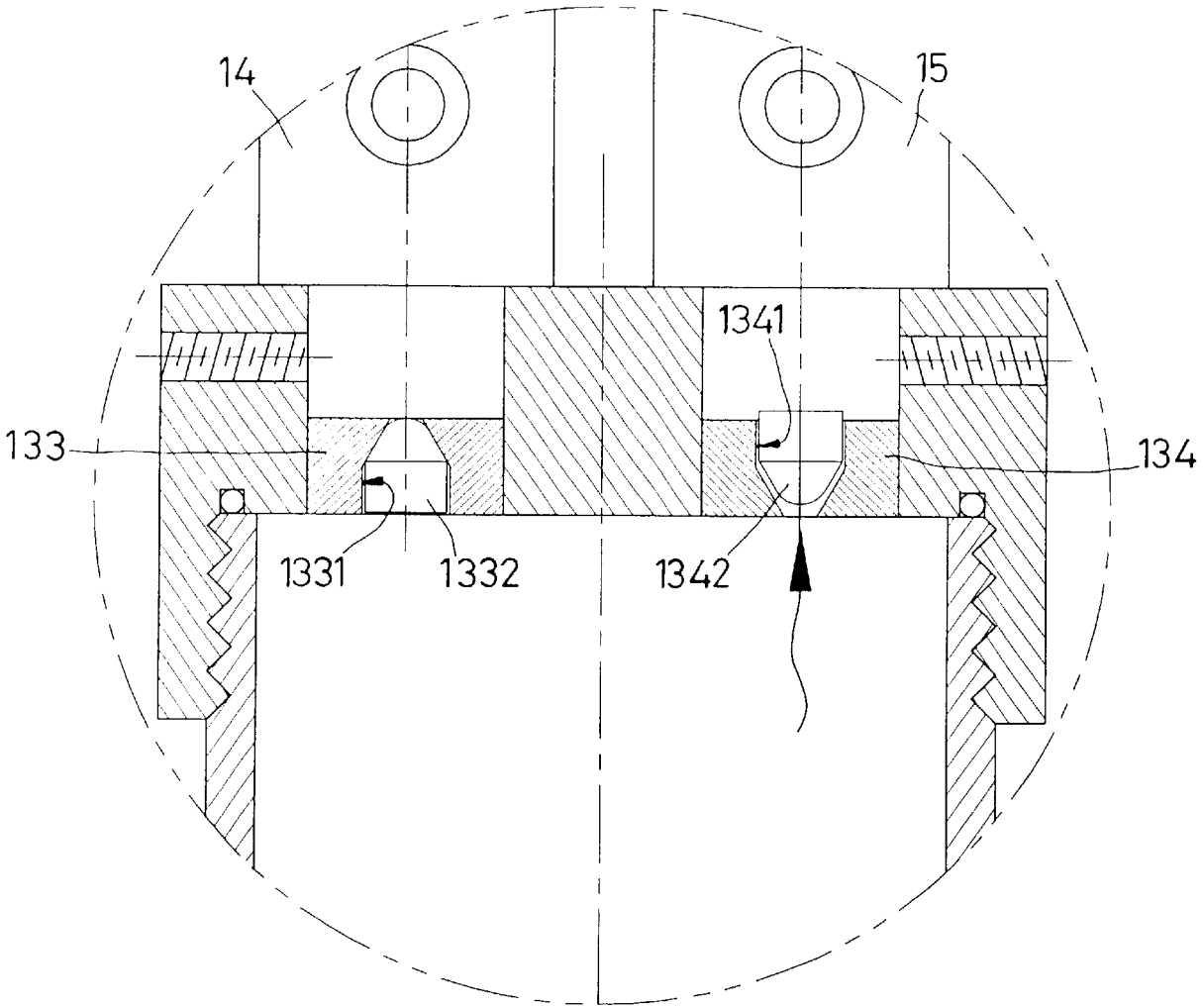
FIG. 15 is a sectional schematic view illustrating air flows into a non-return valve.

Referring to FIGS. 12, 13 and 15, the non-return valve 134 has a second funnel-shaped hole 1341 and a second bulletheaded ball 1342 inserted in the second funnel-shaped hole 1341. When air flows from the inner interior 111 of the hollow cylinder 11 into the non-return valve 134, the air passes through a gap between the second funnel-shaped hole 1341 and the second bulletheaded ball 1342 to enter the exhale joint 15. The non-return valve 134 is a one-way valve.

When the exhale head 152 is inserted in the connection pipe 3, the user can pull the disk 123. Then the check valve 133 is opened and the non-return valve 134 is closed.

When the user pushes the disk 123, the non-return valve 134 is opened and the check valve 133 is closed. Then air will enter the radiator 4.

Figure 9:
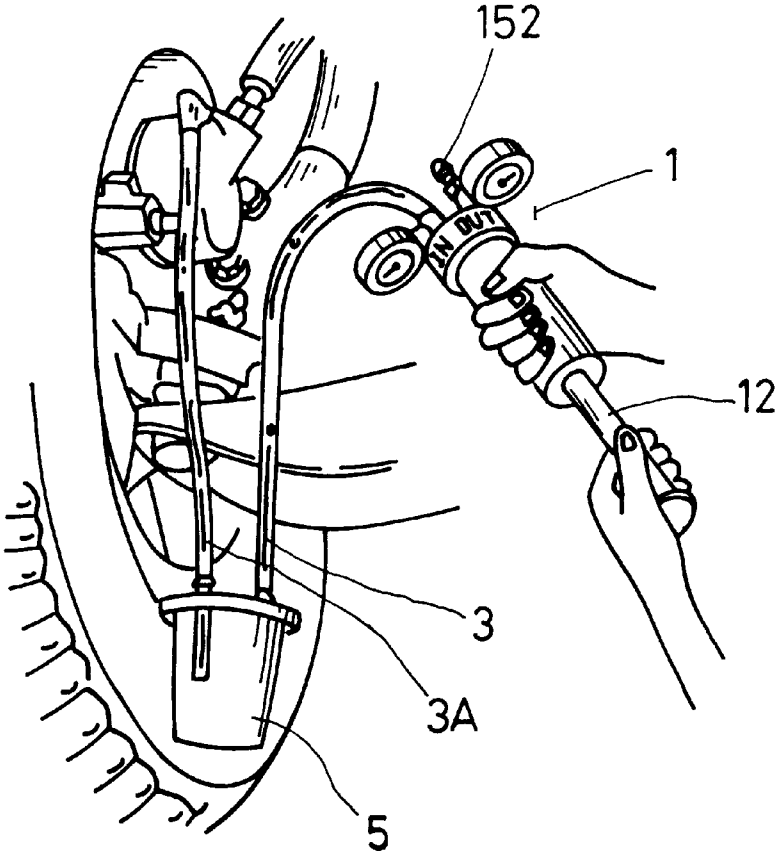
FIG. 9 is a schematic view illustrating a pressure adjusting device of a preferred embodiment extracting oil.

Referring to FIG. 9, a first connection tube 3A is connected to a sealed cup 5 and a container. The connection pipe 3 is connected to the sealed cup 5 and the inhale head 142. When the user pulls the disk 123, the liquid or oil in the container will flow into the sealed cup 5.

Figure 10:
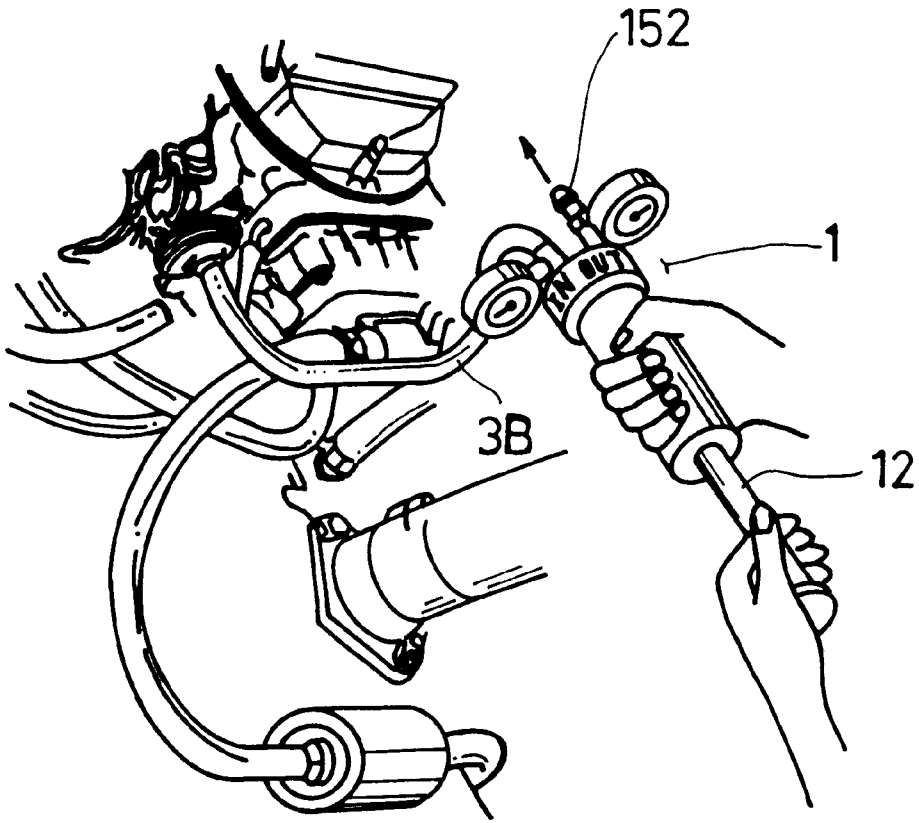
FIG. 10 is a schematic view illustrating a pressure adjusting device of a preferred embodiment extracting air.

Referring to FIG. 10, a second connection tube 3B is connected to the inhale head 142 and a container (not shown in the figure). When the user pulls the disk 123 and pushes the disk 123 continuously, the air in the container will be extracted until the container is in vacuum.

The present invention has the following advantages. The stepped post can be inserted in various inlets of different radiators while the radiators have different sizes. The stepped post can seal the inlet of the radiator. Furthermore, the present invention provides a pressure adjusting device which can combine an air inflation tool and an air extraction tool together.

The present invention is not limited to the above embodiment but various modification thereof may be made. Furthermore, various changes in form and detail may be made without departing from the scope of the present invention.

I claim:

1. A pressure adjusting device for engine cooling system comprises:

a pumping device, a connector device, and a connection pipe connected to the pumping device and the connector device, the pumping device having a hollow cylinder, a plunger device inserted through the hollow cylinder, a cover, a check valve, a non-return valve, an inhale joint, an inhale pressure meter, an exhale joint, and an exhale pressure meter, the hollow cylinder having an inner interior, a through hole, a vent aperture, and a distal thread, the plunger device having a drive rod, a disk disposed on a first end of the drive rod, a piston disposed on a second end of the drive rod, and an O-ring surrounding the piston, the piston inserted in the inner interior of the hollow cylinder, the drive rod inserted through the through hole, the cover having an inner thread engaging with the distal thread of the hollow cylinder, a round aperture receiving the check valve and a circular aperture receiving the non-return valve, a lower end of the inhale joint inserted in the round aperture, a bolt fastening the cover and the inhale joint together, the inhale joint having an inhale head, a lower end of the exhale joint inserted in the circular aperture, the exhale joint having an exhale head, the inhale joint connected to the inhale pressure meter, the exhale joint connected to the exhale pressure meter, the connector device having a stepped post having a through aperture, a threaded rod inserted through the through aperture, a collar enclosing a lower end of the stepped post, a handle bar disposed on the stepped post, and a hollow button disposed on the handle bar, the threaded rod having a head portion, a bottom flange, a threaded portion, and a vent hole, a washer enclosing the bottom flange, the handle bar having a flat plate and two bevel plates connected to the flat plate, the flat plate having a center hole, an annular insertion block inserted in the hollow button, the annular insertion block having a threaded interior receiving the threaded portion of the threaded rod, the threaded rod passing through the center hole of the flat plate and the hollow button, the head portion of the threaded rod inserted in an end of the connection pipe, the check valve having a first funnel-shaped hole and a first bulletheaded ball inserted in the first funnel-shaped hole, and the non-return valve having a second funnel-shaped hole and a second bulletheaded ball inserted in the second funnel-shaped hole.

2. The pressure adjusting device for engine cooling system as claimed in claim 1, wherein the stepped post tapers downward.

* * * * *